US011930947B1

(12) United States Patent
Stewart

(10) Patent No.: US 11,930,947 B1
(45) **Date of Patent: *Mar. 19, 2024**

(54) READY HANGER

(71) Applicant: Enjoyal, LLC, Scottsdale, AZ (US)

(72) Inventor: Ryan M. Stewart, Phoenix, AZ (US)

(73) Assignee: Enjoyal, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/903,292

(22) Filed: Sep. 6, 2022

Related U.S. Application Data

(63) Continuation of application No. 16/695,227, filed on Nov. 26, 2019, now Pat. No. 11,464,351.

(60) Provisional application No. 62/772,623, filed on Nov. 28, 2018.

(51) Int. Cl.
*A47G 25/40* (2006.01)

(52) U.S. Cl.
CPC ..... *A47G 25/4015* (2013.01)

(58) Field of Classification Search
USPC ..... 223/85, 88, 89
See application file for complete search history.

(56) References Cited

U.S. PATENT DOCUMENTS

| | | | | |
|---|---|---|---|---|
| 5,645,200 | A | 7/1997 | Mcdowell | |
| 6,036,062 | A | 3/2000 | von Fabris auf Mayerhofen | |
| 6,315,176 | B1 * | 11/2001 | Abdi | A47G 25/32 223/85 |
| 2014/0158724 | A1 | 6/2014 | Merandi | |
| 2017/0000278 | A1 | 1/2017 | Hansen et al. | |
| 2018/0028008 | A1 * | 2/2018 | Hosono | A47G 25/32 |

* cited by examiner

*Primary Examiner* — F Griffin Hall
(74) *Attorney, Agent, or Firm* — Invention To Patent Services; Alex Hobson

(57) ABSTRACT

A ready hanger automatically pivots about a hinge to raise an arm of the hanger up to make it easy to find the empty hangers in a crowded closet. A hinge is configured between the hook portion and hanger portion and a weighted portion creates an imbalance in the hanger portion to cause it to rotate about the hinge. The hanger portion rotates to produce an inclined end that extends up above the clothes and other hangers in the closet. The weighted portion may be configured proximal an extended end of the arm extension to produce torque to cause the hanger portion to rotate. The hanger portion rotates automatically to an incline angle from horizontal of at least 15 degrees or more. A spring element may be configured between the hook portion and hanger portion to produce the torque required to rotate the hanger portion and produce the inclined end.

13 Claims, 6 Drawing Sheets

READY HANGER

CROSS REFERENCE TO RELATED APPLICATIONS

This application is a continuation of U.S. patent application Ser. No. 16/695,227, filed on Nov. 26, 2019, which claims the benefit of priority to U.S. provisional patent application No. 62/772,623, filed on Nov. 28, 2018; the entirety of which is hereby incorporated by reference herein.

FIELD OF THE INVENTION

The present invention relates to a clothes hanger that, when not is use to hang an article of clothing, automatically pivots to raise an inclined arm up; thereby making it easy to find the empty hangers.

BACKGROUND

Empty clothes hangers are routinely hidden amongst the hangers with clothes hanging thereon. When hanging clothes in the closets, it can be difficult to find an available hanger. There exists a need for a convenient way to quickly identify empty clothes hangers in a closet.

SUMMARY OF THE INVENTION

The invention is directed to a ready hanger, or a hanger that automatically rotates about a hinge to produce an inclined end that is clearly visible above the clothes and other hangers in a closet. An exemplary ready hanger comprises a hinge or pivot point between a hook portion and a hanger portion. An exemplary hanger portion comprise a pair of arm extensions, an inclined arm and a declined arm, that extend out from the hook portion in opposing directions. When the ready hanger is configured of a closet rod, the inclined arm is inclined or raised up while the declined arm is declined. The hanger portion of an exemplary ready hanger has a hanger portion center of gravity that is offset, a hinge offset distance, from the hinge. This offset center of gravity may be produced by a weighted portion that creates an imbalance about the hinge to cause the hanger portion to rotate and produce the inclined end. A weighted portion may be a heavier portion of one of the arm extensions, and is preferably on the declined arm, or produced by the declined arm, and may be produced by the geometry and design of the ready hanger, or the addition of a material, a dip coating or wrap of material about one of the arm extensions, for example. The declined arm may be larger in dimension, such as diameter, than the inclined arm over at least a portion of the declined arm, such as proximal to the extended end of the declined arm to produce a weighted portion. It may be desirable to have the weighted portion proximal to the extended end of the declined arm to produce increased torque about the hinge. One of the arm extensions may be longer than the other arm extension to produce a weighted portion. The pair of arm extensions may be coupled together at an offset distance from the hinge to cause a torque about the hinge and a weighted portion.

In an exemplary embodiment, that two arm extension are coupled together at an offset distance from the hook portion or hinge portion. An offset portion of the hanger portion may extend from where the arm extensions are coupled together to the hook portion or hinge portion. This offset distance will produce an imbalance in the hanger portion, or a weighted portion to cause the hanger portion to rotate about the hinge to produce an inclined end.

An exemplary hinge may comprise a pin and aperture, a loop or pair of loops, a flexible portion or any combination thereof. In an exemplary embodiment, a hinge comprises an aperture in one of the hook or hanger portions and an extension through the aperture by the opposing component. A hinge may comprise a hanger loop and/or a hook loop. These loops may be continuous loops that form a ring or discontinuous loops that form a hook, for example. An exemplary hinge may comprise a flexible portion of the hook portion, such as along the hook extension. The flexible portion may comprise a flexible material, such as an elastomer or a corrugated material.

An exemplary ready hanger comprises a spring element that extends between the hook portion and the hanger portion. A spring element may be configured in tension to produce a force to pull the arm extension toward the hook portion and produce an inclined end. A spring element may comprise a coiled spring or an elastic material such as rubber, urethane, silicone and the like. An elastic material is a material that can be deformed, such as by stretching and return substantially to an original shape or length when the deforming load is removed. Note that a spring element may also be configured in compression to produce a force between the hook portion and one of the pair of arm extensions to produce an incline angle.

An exemplary ready hanger has a center of gravity that is offset a gravity offset distance, from a center axis of the hook to cause the hanger to rotate to an incline angle when hung from a hanger rod. The offset center of gravity may be formed by a weighted portion or by the geometry and configuration of the hook with respect to the hanger portion. The hook portion may be offset from a conventional vertical position to produce the gravity offset distance. The hook portion may extend over the inclined arm with the center axis of the hook configured over the inclined arm, thereby producing a center of gravity between the hook portion and the extended end of the declined arm. The hook extension may extend at a hook offset angle from vertical to configure the hook portion over the inclined arm. The center axis of the hook is a vertical axis drawn through the hook, such as through a center point with respect to the radius of curvature of the hook. A hook is typically a partial ring having a diameter and the center axis of the hook may extend through the center of this partial ring, or again the center point for the radius of curvature.

An exemplary ready hanger may be a one-piece continuous part, or monolithic part, such as an injection molded or otherwise molded part. The ready hanger may be molded from a plastic material and the arm extensions may be circular in cross-section and a portion of the declined arm may be larger to produce a weighted portion.

An exemplary ready hanger will automatically produce an inclined end when hung from a hanger rod empty. The inclined arm extension will be inclined at an inclined angle from horizontal of at least 15 degrees or more, and preferably at least 25 degrees or more, and even more preferably at least 35 degrees of more.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
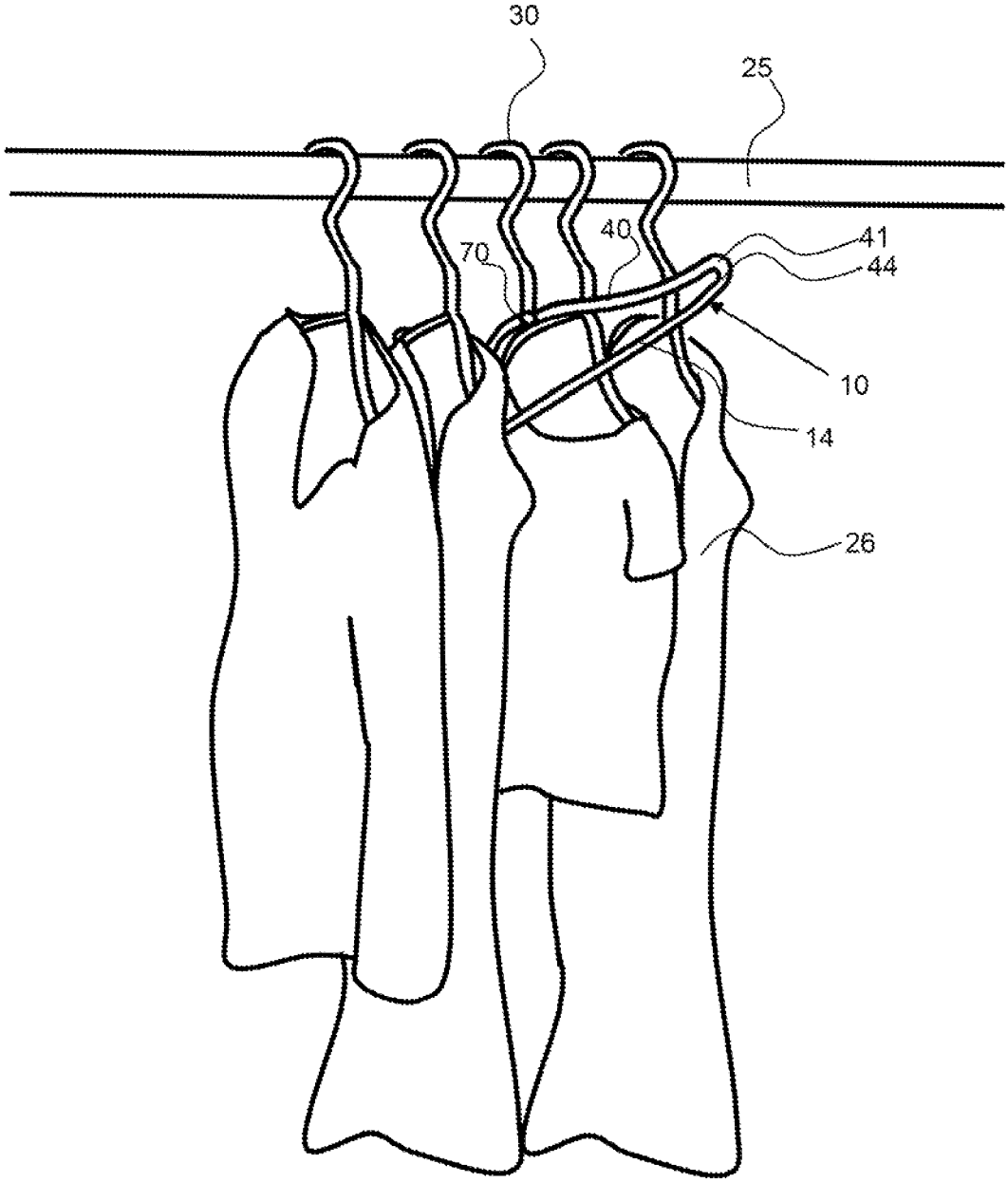
FIG. 1 shows an exemplary ready hanger with the inclined arm of the hanger portion tilted or rotated to expose an inclined end of the inclined arm.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary ready hanger 10 automatically exposes an inclined end 44 of the inclined arm 41. A hinge 70 between the hook portion 30 and the hanger portion 14 allows the hanger portion to rotate about the hook portion to expose the inclined end, when an article of clothing is not hung thereon. The arm extensions 40 extend from the hook portion 30. This enables a person to quickly find the empty hangers on the hanger rod 25 and between the other garments 26.

Figure 2:
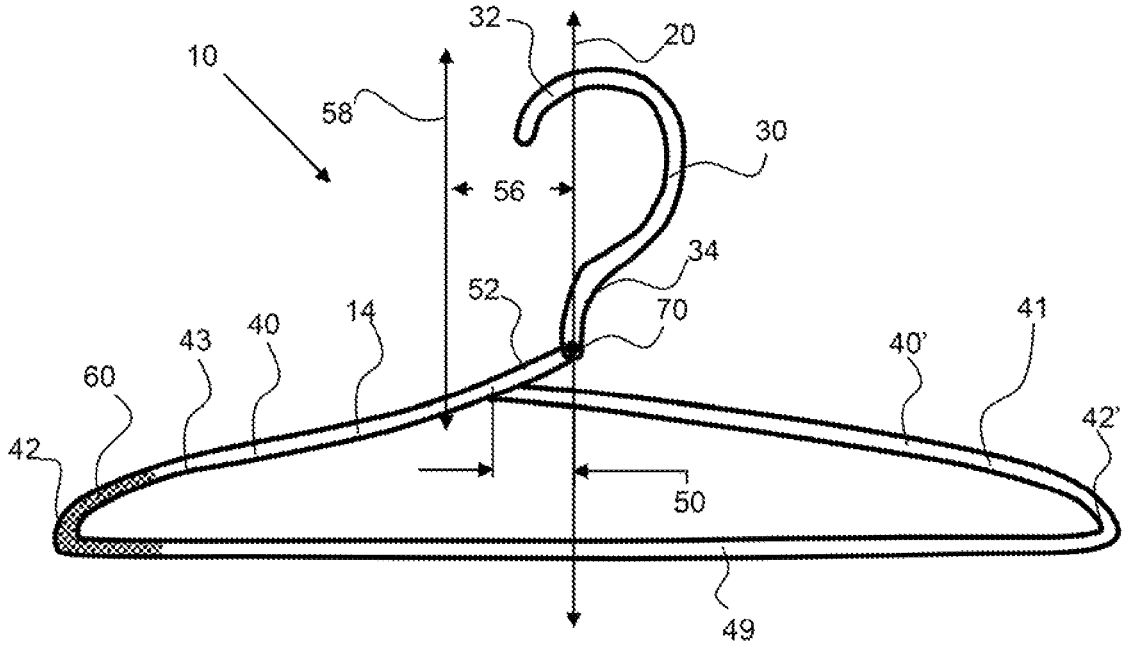
FIG. 2 shows an exemplary ready hanger having a hinge or pivot between the hook portion and the hanger portion and a weighted portion on one of the arm extensions.
Figure 3:
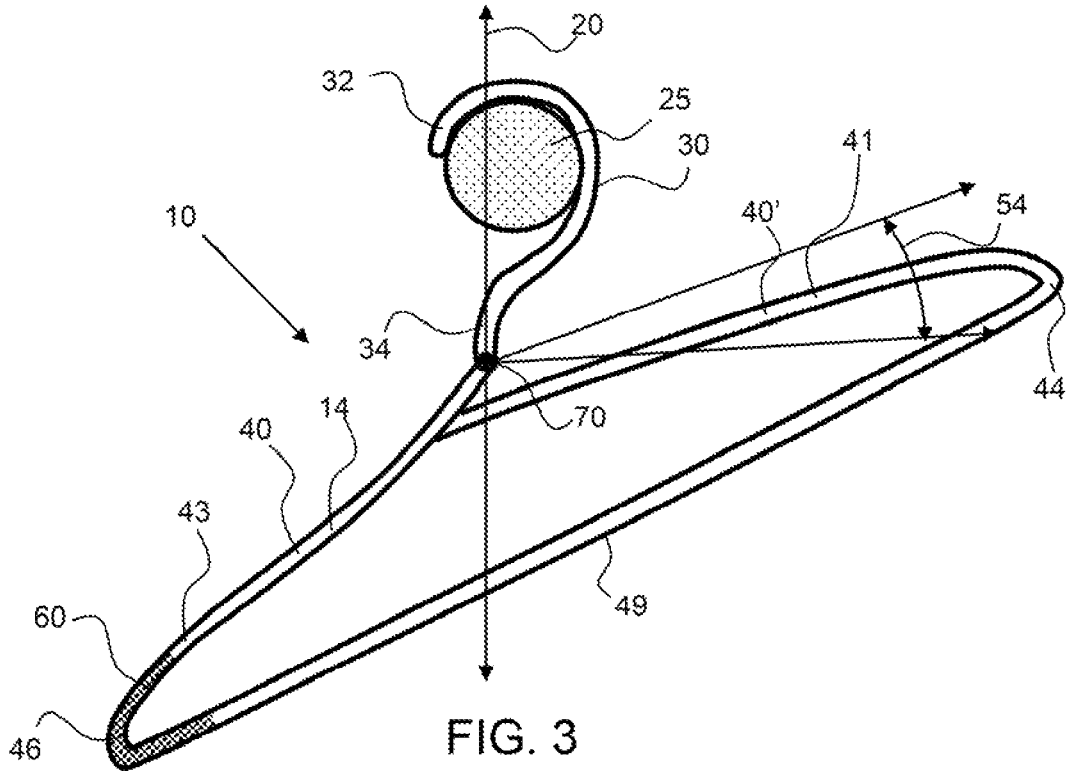
FIG. 3 shows the exemplary ready hanger of FIG. 2, hung on a hanger rod with the hanger portion rotated about the hinge to expose an inclined end of the inclined arm.

Referring now to FIGS. 2 and 3, an exemplary ready hanger 10 has a hinge 70 or pivot between the hook portion 30 and the hanger portion 14 and a weighted portion 60 on declined arm 43 of the arm extensions 40. The arm extensions 40 and 40' are coupled together an offset distance 50 from the hook portion or the hinge. This offset distance creates an imbalance in the weight between the two sides of the hanger portion, or a weighted portion that produces torque about the hinge and causes the hanger portion to rotate about the rotational axis 20, as shown in FIG. 3 to raise the inclined arm 41 at an inclined angle 54. An offset portion 52 of the hanger portion 14 extends from the hinge 70 or hook portion to where the two arm extensions are coupled together. As shown in FIG. 3, the hanger portion has rotated about the hinge 70 to produce an inclined end 44 of the inclined arm 41 and a declined end 46 of the declined arm 43. The inclined end 44 is the extended end 42' and the declined end 46 is the extended end 42. The hanger has rotated up from horizontal to an incline angle 54. The inclined end 44 will be easily visible above the clothes and other hangers in the closet. The hanger portion may have a connector 49 that extends between the two arm extensions, such as from the two extended ends 42, 42'. The hook portion 30 has a hook extension 34 from the pivot or hinge 70 and a hook 32 that is used to hang the ready hanger from a hanger rod 25. The hanger portion 14 has a center of gravity 58, depicted by the vertical line axis, that is offset a hinge offset distance 56 from the hinge 70. This offset of the center of gravity of the hanger portion from the hinge causes the hanger portion to rotate about the hinge to produce an inclined end as shown in FIG. 3. Note that the amount of weight and position of the weighted portion will affect the position of the center of gravity of the hanger portion and can be used to increase the hinge offset distance.

Figure 4:
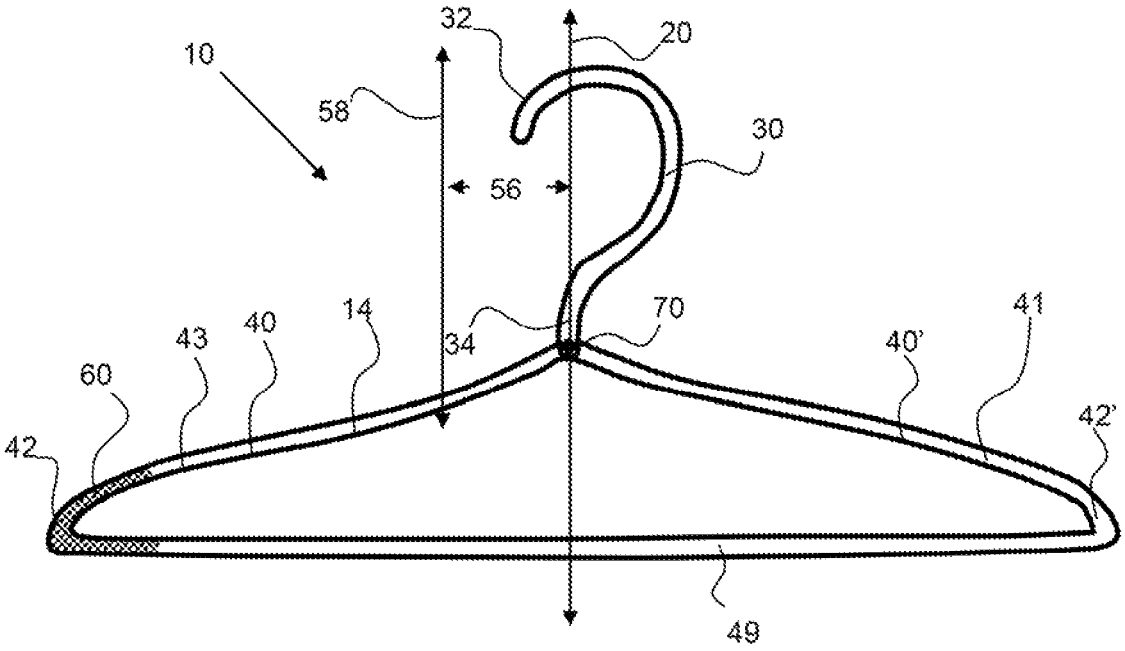
FIG. 4 shows an exemplary ready hanger having a hinge or pivot between the hook portion and the hanger portion and a weighted portion on the extended end of the declined arm.

As shown in FIG. 4, an exemplary ready hanger 10 has a hinge 70 or pivot between the hook portion 30 and the hanger portion 14 and a weighted portion 60 on the declined arm 43. In this embodiment, the two arm extensions are coupled together without an offset distance as shown in FIG. 2.

Figure 5:
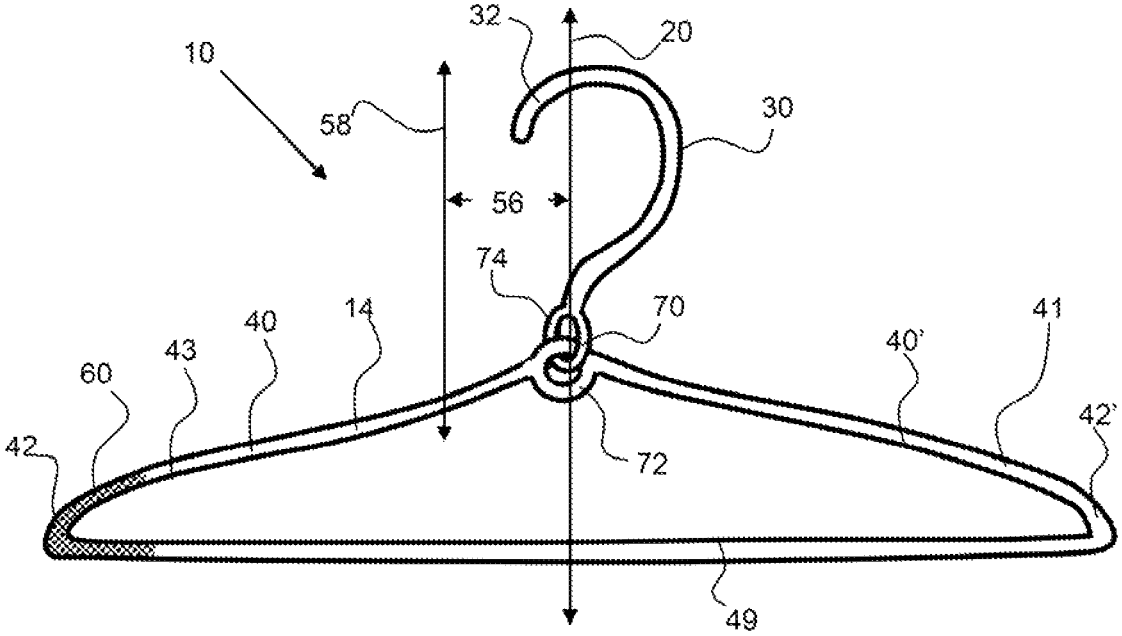
FIG. 5 shows an exemplary ready hanger having a hinge comprising a ring between the hook portion and the hanger portion and a weighted portion on the extended end of the declined arm.

As shown in FIG. 5, an exemplary ready hanger 10 has a hinge 70 or pivot between the hook portion 30 and the hanger portion 14 and a weighted portion 60 on one of the arm extensions 40. In this embodiment, the hinge comprises a pair of loops, a hanger loop 72 and a hook loop 74 that are connected to form a hinge. Note that the loops may be continuous loops as shown or may be partial loops, or hooks. Also note that a single loop may be configured in an aperture. For example, the hanger portion may be configured with a loop and the hook portion may comprise an aperture for receiving the hanger loop. Again, the hanger portion 14 has a center of gravity 58 that is offset a hinge offset distance 56 from the hinge 70.

Figure 6:
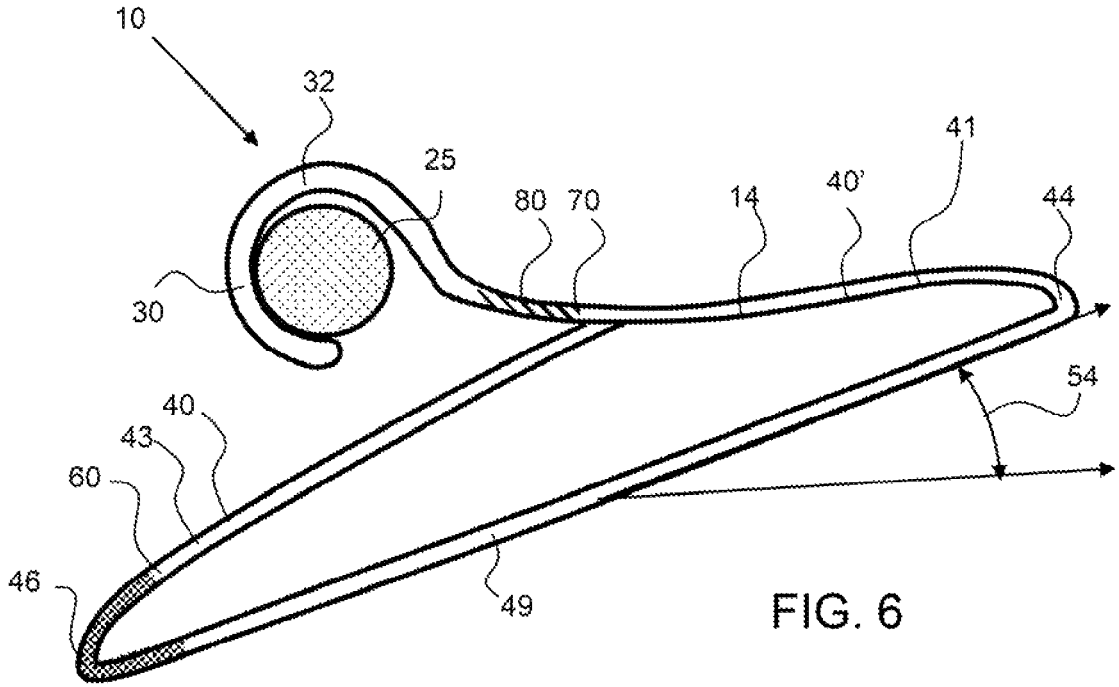
FIG. 6 shows an exemplary ready hanger having a flexible portion 80 between the hook portion and the hanger portion and a weighted portion on the extended end of the declined arm.
Figure 7:
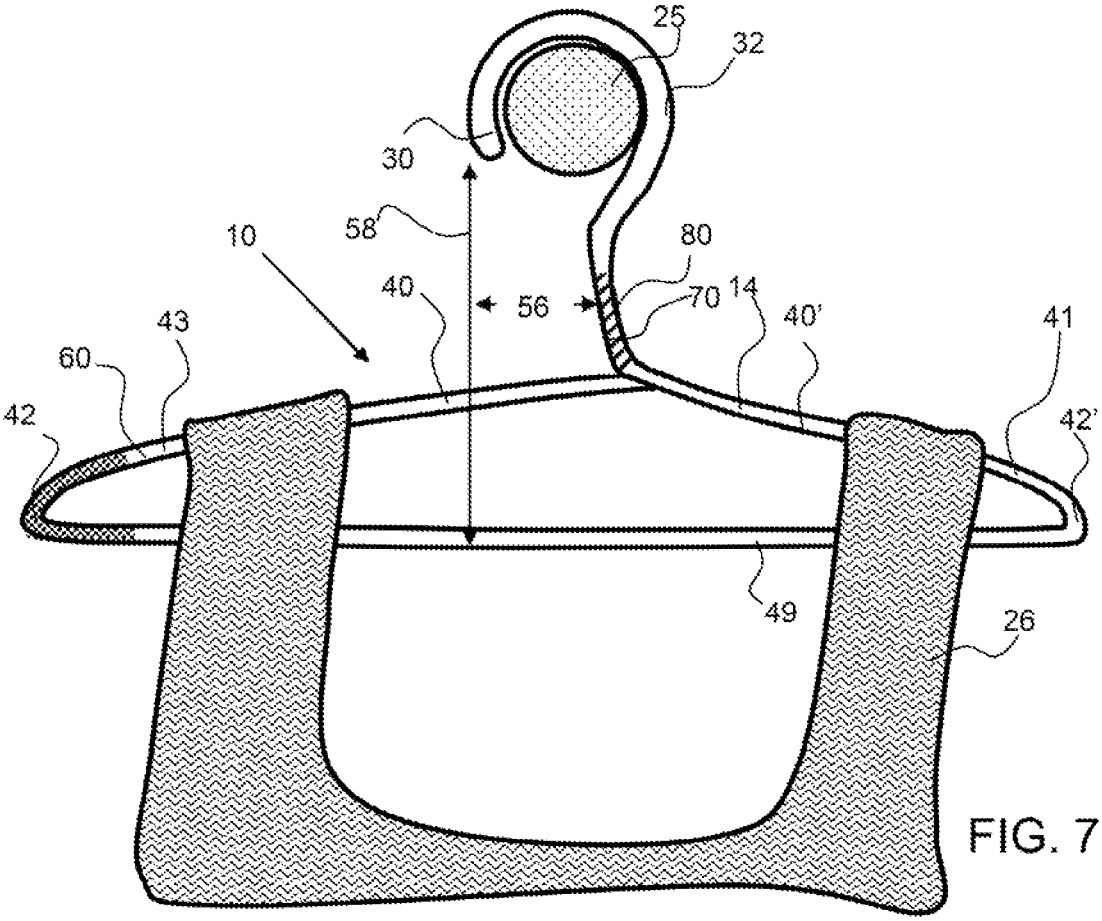
FIG. 7 shows the exemplary ready hanger shown in FIG. 6 with a garment hanging therefrom and the inclined end lowered from the weight of the garment.

As shown in FIG. 6, an exemplary ready hanger 10 has a hinge 70 comprising a flexible portion 80 between the hook portion 30 and the hanger portion 14 and a weighted portion 60 on the declined arm 43 of the two arm extensions 40 40'. In this embodiment, the flexible portion, such as an elastic material, corrugated portion and the like produces a hinge for the hanger portion 14 to rotate about the hook portion. Also note that in this embodiment, the declined arm 43 is longer than the inclined arm 41. As shown in FIG. 7, the exemplary ready hanger of FIG. 6 is rotated flat, or to a position with the two opposing arm extensions extending substantially horizontally, within about 10 or 20 degrees of horizontal. A garment 26 is hanging from the ready hanger 10 and the inclined end 44 is lowered from the weight of the garment.

Figure 8:
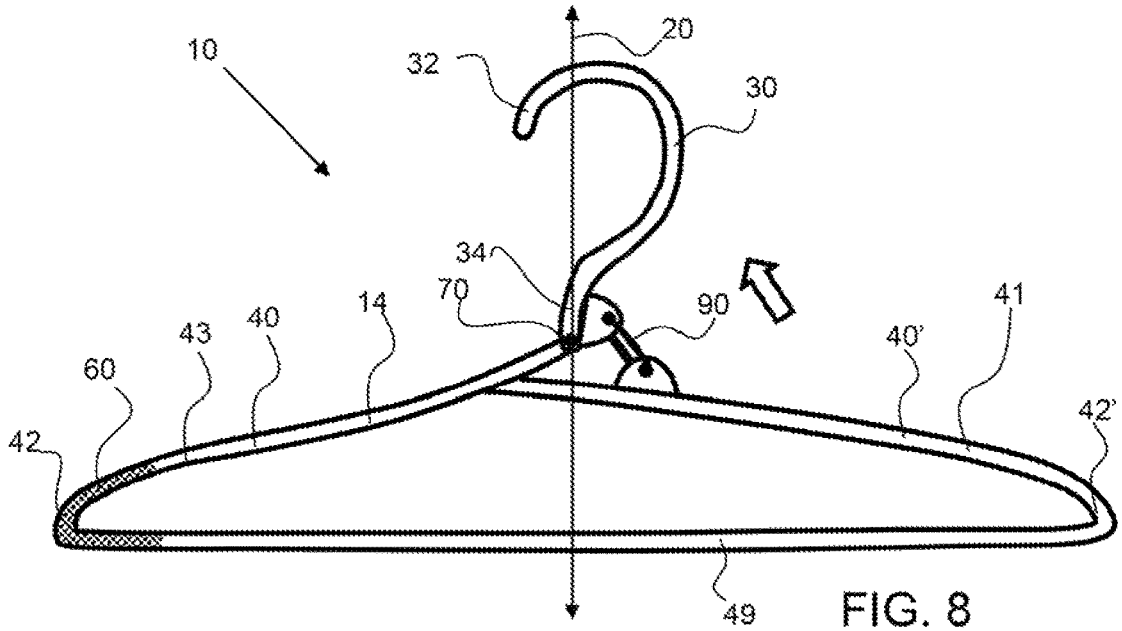
FIG. 8 shows an exemplary ready hanger having a hinge and a spring element between the hook portion and the hanger portion to pull on the inclined arm of the hanger portion.
Figure 9:
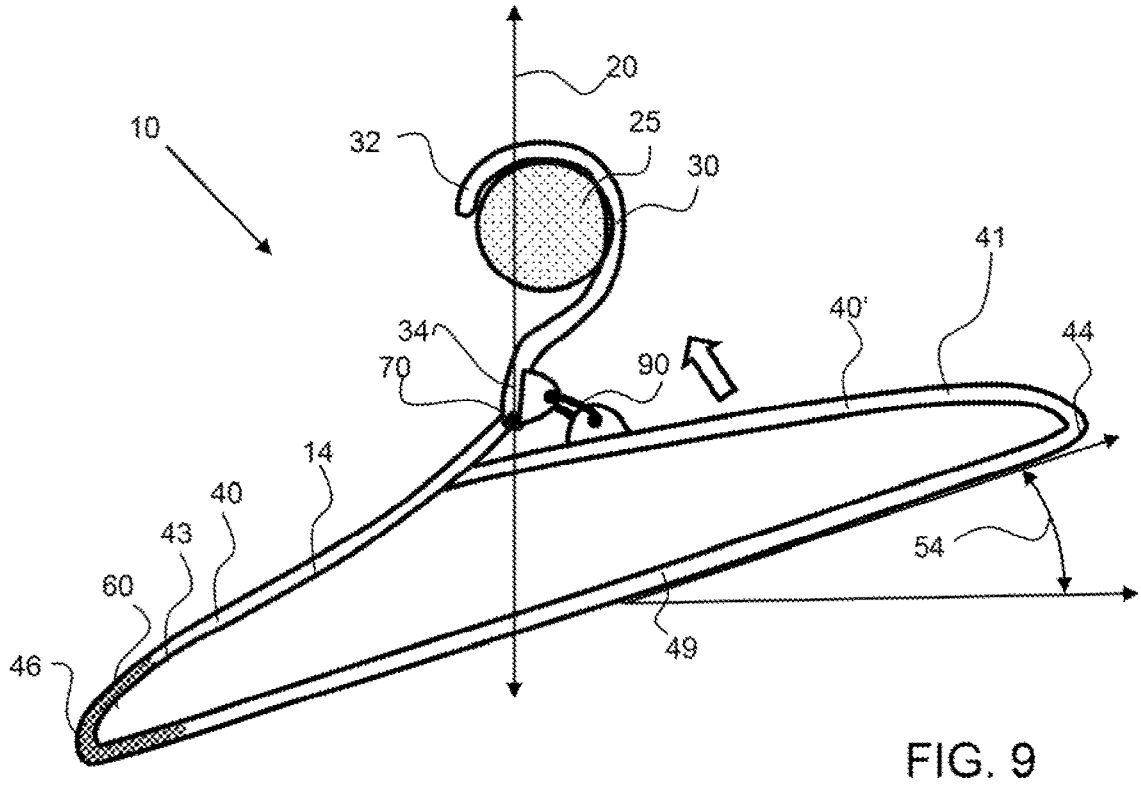
FIG. 9 shows the exemplary ready hanger shown in FIG. 8, hung on a hanger rod with the hanger portion rotated about the hinge to expose an inclined end of the inclined arm.

Referring now to FIGS. 8 and 9, an exemplary ready hanger 10 has a hinge 70 between the hook portion 30 and the hanger portion 14 and a spring element 90 between the hook portion and the hanger portion to pull on the inclined arm 41 of the two arm extensions 40, 40' of the hanger portion. As shown in FIG. 9, the spring element 90 is pulling the inclined arm 41 to produce the inclined end 44. The spring element may be a coiled spring, an elastic material, such as rubber, urethane or silicone for example. Also note that the ready hanger may be configured with a weighted portion 60 and arm extensions with an offset from the hinge, as shown.

Figure 10:
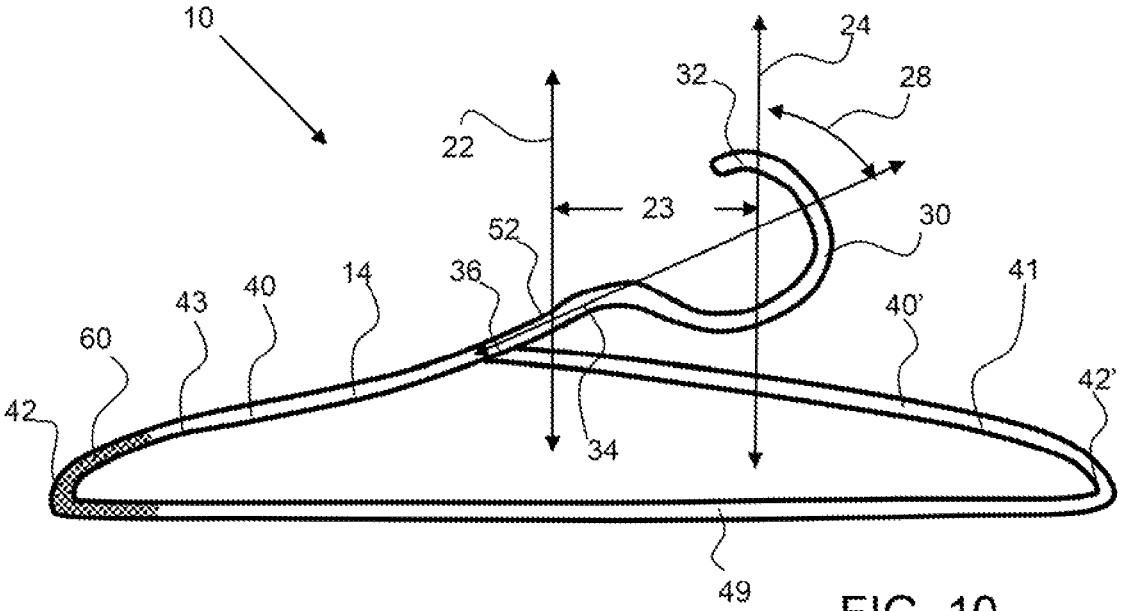
FIG. 10 shows an exemplary ready hanger having an offset center of gravity, wherein the center of the hook is offset from the center of gravity by a gravity offset distance.
Figure 11:
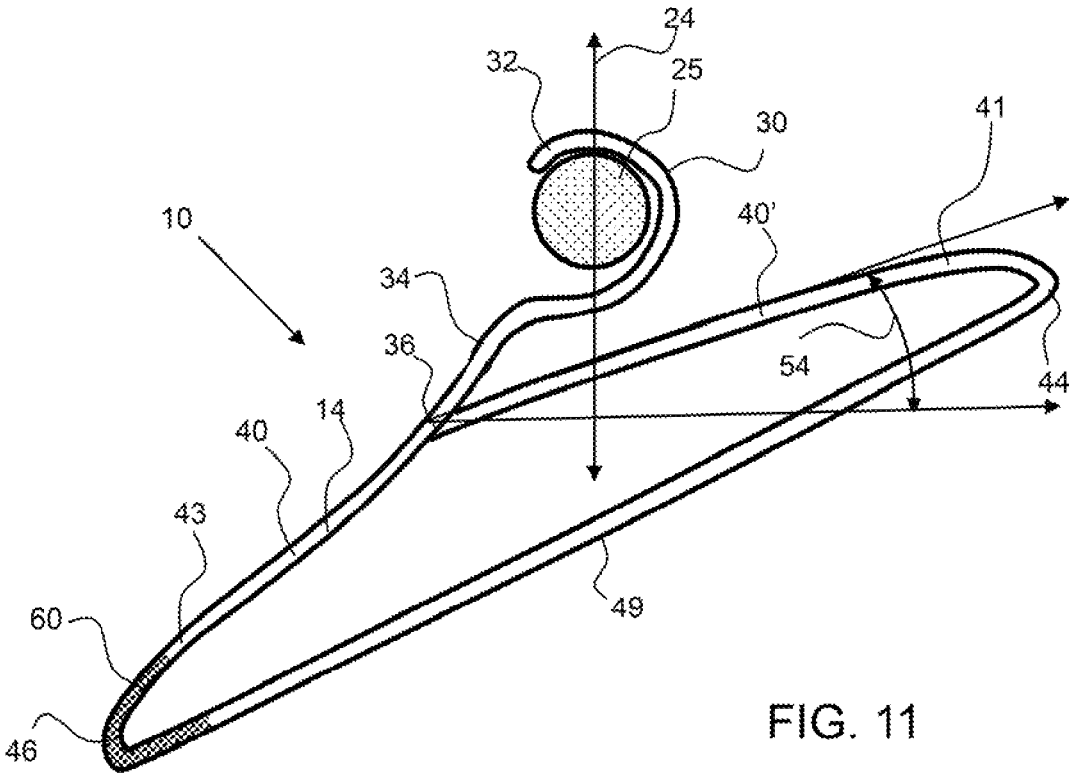
FIG. 11 shows the exemplary ready hanger shown in FIG. 10, hung on a hanger rod with the hanger portion rotated to an incline angle to expose an inclined end of the inclined arm.

Referring now to FIGS. 10 and 11, an exemplary ready hanger 10 has an offset center of gravity axis 22 that is offset a gravity offset distance 23 from the center axis of the hook 24. This offset center of gravity causes the ready hanger to rotate about the hanger rod 25, as shown in FIG. 11, to raise the inclined arm 41, of the two arm extension 40, 40' an incline angle 54. The more the gravity offset distance, the greater the incline angle. Note that the center of gravity can be moved further away from the center axis of the hook by the including of a weighted portion 60 which is shown being configured proximal to the extended end 42 of the declined arm 43. The declined arm may be larger in dimension, such as diameter, than the inclined arm over at least a portion of the declined arm, such as proximal to the extended end of the declined arm to produce a weighted portion. As shown in FIG. 10, a hook offset angle 28 is the offset angle from vertical of a line extending through the center of the hook to the point of connection of the hook portion with the hanger portion. The hook offset angle and gravity offset distance may be configured to produce a desired incline angle 54, as shown in FIG. 11. The hook portion comprises a hook extension 34 and the inclined arm 41 and declined arm 43 are coupled to the hook extension at a coupling portion 36. Note that the hanger shown in FIGS. 10 and 11 may be a one-piece continuous part, being a continuous single piece that may be formed from a single mold, for example.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A ready hanger comprising:

a) a hook portion comprising a hook having a center axis that extends through a center of the hook;

b) a hanger portion coupled to the hook portion and comprising:

i) an inclined arm;

ii) a declined arm;

wherein the inclined arm and declined arm extend in opposing directions;

wherein the center of the hook is configured over the inclined arm to configure the center of the hook a gravity-offset distance from a center of gravity of the ready hanger;

wherein the declined arm has a weighted portion and wherein the declined arm is heavier than the inclined arm;

whereby when the ready hanger is suspended from a hanger rod, the hanger portion extends at an incline angle from horizontal to produce an inclined end; and wherein the inclined arm and the declined arm each have a length from the hook portion to an extended end; and wherein the ready hanger is a molded plastic material and wherein the declined arm is larger in cross-section than the inclined arm to produce the weighted portion;

wherein the ready hanger extends at an incline to horizontal when the ready hanger is suspended from a hanger rod without any clothing or garments hung from the ready hanger.

2. The ready hanger of claim 1, wherein the gravity-offset distance of the center of the hook is at least 25 mm.

3. The ready hanger of claim 1, wherein the ready hanger is a one-piece continuous part.

4. The ready hanger of claim 3, wherein the weighted portion is configured on the declined arm proximal to the extended end of the declined arm.

5. The ready hanger of claim 1, wherein the weighted portion is configured on the declined arm proximal to the extended end of the declined arm.

6. The ready hanger of claim 5, wherein the hanger portion is a one-piece continuous part.

7. The ready hanger of claim 1, wherein the incline angle is at least 15 degrees.

8. The ready hanger of claim 1, wherein the incline angle is at least 25 degrees.

9. The ready hanger of claim 1, wherein the gravity-offset distance of the center of the hook is at least 10 mm.

10. The ready hanger of claim 1, wherein the inclined arm and the declined arm are coupled to the hook portion said gravity-offset distance from the center axis of the hook.

11. The ready hanger of claim 1, wherein the hook portion extends at a hook offset angle from vertical that is at least 20 degrees.

12. The ready hanger of claim 1, wherein the hook portion comprises a hook extension and wherein the inclined arm and declined arm are coupled to the hook extension at a coupling portion.

13. The ready hanger of claim 12, wherein the coupling portion is configured at an extended end of the hook extension.

* * * * *